United States Patent [19]

Theilacker et al.

[11] Patent Number: 4,753,168

[45] Date of Patent: Jun. 28, 1988

[54] ROTARY OFFSET PRINTING MACHINE WITH CLUTCHED CYLINDER ARRANGEMENT

[75] Inventors: Klaus Theilacker, Friedberg; Johann Meitinger, Augsburg, both of Fed. Rep. of Germany

[73] Assignee: MAN - Roland Druckmaschinen AG, Offenbach am Main, Fed. Rep. of Germany

[21] Appl. No.: 35,616

[22] Filed: Apr. 3, 1987

[30] Foreign Application Priority Data

Apr. 25, 1986 [DE] Fed. Rep. of Germany ..... 3614029

[51] Int. Cl.[4] ..... B41F 5/04; B41F 5/22

[52] U.S. Cl. ..... 101/177; 101/220

[58] Field of Search ..... 101/177, 178, 179, 180, 101/181, 182, 185, 220, 221, 225, 137, 138, 139, 140, 143, 144, 145, 247

[56] References Cited

U.S. PATENT DOCUMENTS

| | | | |
|---|---|---|---|
| 3,742,849 | 7/1973 | Greiner et al. | 101/220 |
| 4,394,835 | 7/1983 | Gertsch et al. | 101/177 |
| 4,398,464 | 8/1983 | Morbitzer et al. | 101/177 |
| 4,696,229 | 9/1987 | Bezler et al. | 101/177 |

FOREIGN PATENT DOCUMENTS

| | | | |
|---|---|---|---|
| 2024482 | 12/1971 | Fed. Rep. of Germany | 101/220 |
| 3510823 | 9/1986 | Fed. Rep. of Germany . | |
| 0080464 | 7/1981 | Japan | 101/220 |

*Primary Examiner*—Clifford D. Crowder

*Attorney, Agent, or Firm*—Frishauf, Holtz, Goodman & Woodward

[57] ABSTRACT

To permit selective operation of a rubber blanket—plate cylinder couple located, respectively, above and below an impression cylinder for double prime printing, prime-and-verso printing, or printing plate change while printing is carried out with a remaining couple and during operation of the machine, two clutches (21 or 25) selectively feed a main rotary drive from a main gear (18, 19) to the drive gears (22, 23) of the upper blanket cylinder—plate cylinder couple (2, 4) or, upon operation of a clutch (25) via drive gears (26, 27) to the lower blanket cylinder—plate cylinder couple (3, 5). For prime-and-verso printing, only one of the clutches (e.g. 21) is operated. A further clutch (29) located on the shaft (13) of the upper blanket cylinder (2) can be coupled to the blanket cylinder shaft by a third clutch (29) which, for plate exchange during machine operation, is disengaged and, upon engagement, permits operation of the second blanket cylinder—plate cylinder couple in reverse direction—with respect to double-prime printing—while the second impression cylinder (25) then will spin freely on its shaft.

3 Claims, 3 Drawing Sheets

ROTARY OFFSET PRINTING MACHINE WITH CLUTCHED CYLINDER ARRANGEMENT

Reference to related applications and patent, assigned to the assignee of the present application, the disclosures of which are hereby incorporated by reference:

U.S. Ser. No. 07/031,700 filed Mar. 27, 1987, Fischer;

U.S. Ser. No. 07/040,635, filed Apr. 21, 1987, Liebert et al.

U.S. Pat. No. 4,696,229, to which German patent Disclosure Document DE-OS No. 35 10 823 corresponds.

The present invention relates to rotary offset printing machines, and more particularly to such printing machines in which plate on a plate cylinder can be changed while the printing machine is operating, that is, while the printing machine prints on another plate—blanket cylinder couple. Of course, the plate cylinder and the blanket cylinder couple is stopped when the plate on the plate cylinder is to be exchanged.

BACKGROUND

Various types of offset printing machines, using plate cylinder—rubber blanket cylinder couples—are so arranged that the machine can operate in different printing modes. In one type of machine, a five-cylinder is provided, having a printing or impression cylinder and two plate cylinder—blanket cylinder couples. If the printing arrangement is to be such that one blanket cylinder forms the impression or printing cylinder for another blanket cylinder, the already present impression or counter or printing cylinder is then used merely as a paper guide cylinder element. Alternatively, the arrangement can be such that two blanket cylinders of the respective plate—blanket cylinder couples—are engaged with the printing or impression cylinder. This permits two-color prime printing. The respective engagement or disengagement can be effected, as well known, by shifting the center of rotation of the centers of rotation of the respective cylinders.

The cylinders are rotated by being coupled to gears which mesh, for example, with a drive gear which is driven from a main printing machine drive.

To drive the blanket cylinders, gears can be located on the shafts thereof as well as on the impression cylinder and, respectively, a first and second clutch can then be provided for selectively coupling the main drive to one of the two blanket cylinder gears.

The system can be so arranged that all the gears are located on one side of the machine. To permit different operating modes, the gears are shifted. The gears, at least in part, provide for profile correction or offset.

THE INVENTION

It is an object to provide a rotary offset printing machine which can operate in various printing modes, and more particularly a five-cylinder printing machine in which the gears do not use any significant profile offset, and are in continuous engagement, so that shifting of the gears is not necessary. This permits change of a printing plate during operation of the machine, i.e. flying plate change.

Briefly, a main drive gear is in continuous rotary engagement with the shaft of the printing or impression cylinder. First and second clutches are provided to couple gears associated therewith, selectively, to the shafts of the first or second rubber cylinder. In accordance with a feature of the invention, a third clutch is provided, operable selectively to couple an additional gear connected to one of the blanket cylinders with the shaft of that one blanket cylinder. The arrangement permits, selectively, activation of the respective clutches to apply the main drive to the impression cylinder and via one of the clutches to one of the blanket cylinders or to both of the blanket cylinders by additional operation of the third clutch so that, selectively, either one or both of the blanket cylinders can be driven, positively, and in synchronism with the impression cylinder. Preferably, respective gears and clutches are located on both sides of the cylinders. One of the gears of one of the rubber cylinders is preferably of double width, since it can be placed in engagement, selectively, with the other rubber cylinder or with the impression cylinder only.

DRAWINGS

DETAILED DESCRIPTION

Figure 1:
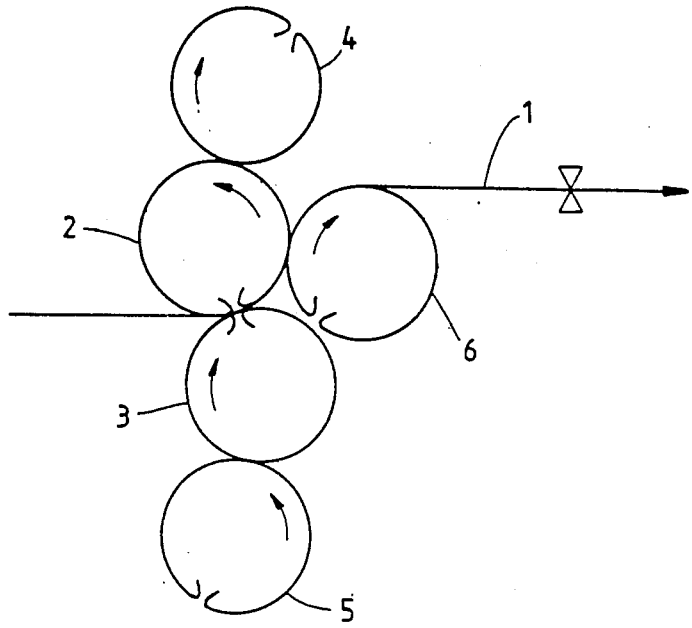
FIG. 1 is a schematic representation of the printing system of the printing machine of the present invention for prime-and-verso printing.
Figure 2:
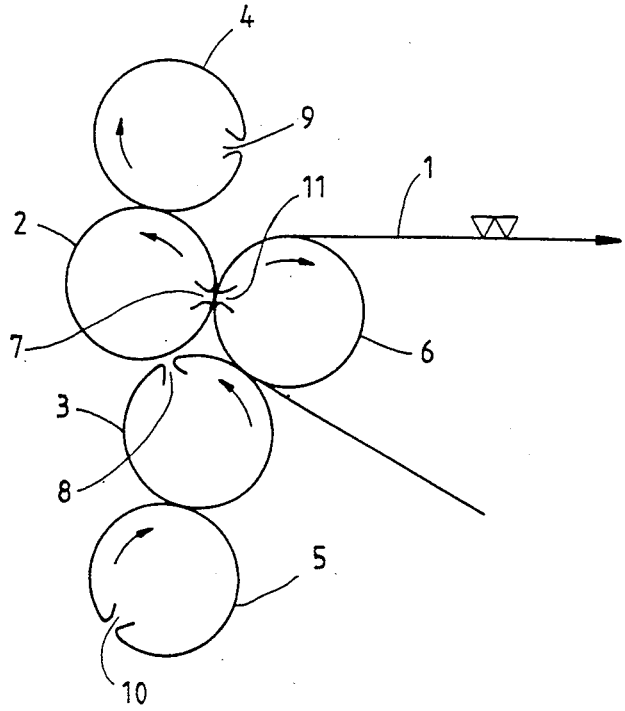
FIG. 2 illustrates the arrangement of the cylinders for double prime printing.

The printing system shown in FIGS. 1 and 2 permits versatile printing. It uses five cylinders, through which a web 1 can be guided. As shown in FIG. 1, prime and verso printing can be applied between two blanket cylinders 2, 3, each having an associate plate cylinder 4, 5. The blanket cylinder 2 uses the blanket cylinder 3 as impression cylinder, and vice versa. The impression cylinder 6 is used as a paper guide roller or cylinder. As seen in FIG. 2, and by changing the path of the web 1, double prime printing, for example in two colors, can be effected, in which both blanket cylinders 3 are engaged with the impression cylinder 6.

The system permits exchange of printing plates while printing is carried out on the web 1, although only with a single color, for example on prime printing. In that case, and as known, a blanket cylinder—plate cylinder pair is stopped to permit interchange of a printing plate on the respective plate cylinder; the other blanket cylinder—plate cylinder pair or couple is used to continue the single color printing on the substrate. The printing system of the printing machine has two blanket cylinder—plate cylinder couples 2, 4 and 3, 5. In the operating mode shown in FIG. 1, the printed web 1 is printed on both sides, that is, has prime and verso printing, effected by passing the web between the two blanket cylinders 2, 3. The impression cylinder 6 can be engaged with the upper blanket cylinder 2, or can be spaced slightly therefrom, to function only as a paper guide roller. In the operating mode shown in FIG. 2, double color prime printing is applied to the paper web. The respective printing is shown by small triangles on the web 1. In the mode shown in FIG. 2, the impression cylinder 6 is a common impression cylinder, engaged with both blanket cylinders 2 and 3. Of course, in that operating mode, the blanket cylinders 2, 3 must be spaced from each other. Shifting of the centers of the respective cylinders can be done as well known, for example by placing the shafts of the respective cylinders in bearings or bushings which can be moved eccentrically within the side walls of the machine—as well known, and not shown for clarity.

The respective cylinders 2–6 have clamping grooves 7, 8, 9, 10, 11 for application of printing plates or, respectively, printing blankets. The impression cylinder 6 likewise may have a blanket applied thereto. In the various operating modes, the respective cylinders must be aligned with each other so that the cylinder grooves match. Thus, in the arrangement shown in FIG. 1, groove 8 of blanket cylinder 3 must be opposite groove 7 of the blanket cylinder 2. Upon change of production to the mode in FIG. 2, the lower blanket cylinder 3 must be rotated to such an extent that its groove 8 fits against and matches the groove 11 of the impression cylinder 6.

In accordance with a feature of the invention, three clutches are provided which permit coupling the respective drives to the cylinders in predetermined angular relationship with each other. Thus, the clutches are preferably arranged as fixed point, positive engagement clutches.

Figure 3:
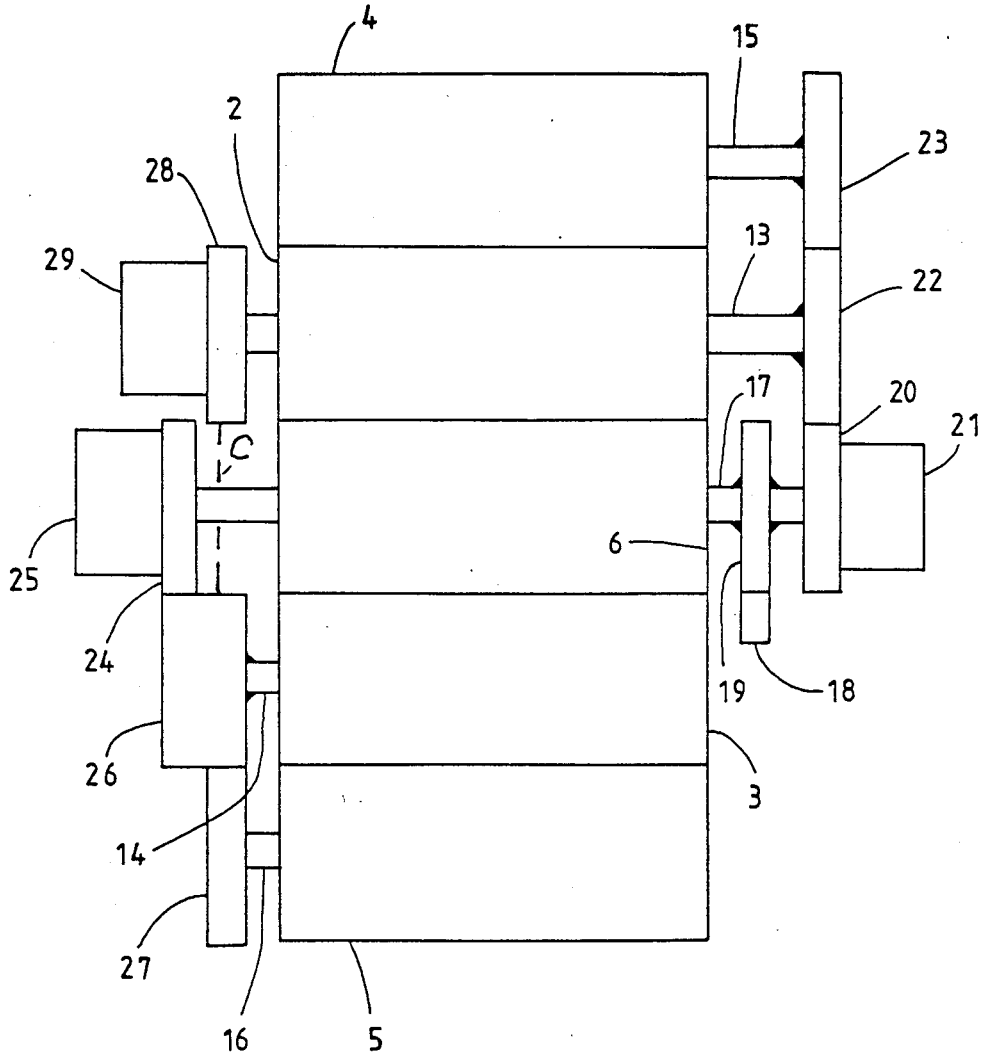
FIG. 3 is a developed plan view showing the drive arrangement of the printing system of FIGS. 1 and 2.
Figure 4:
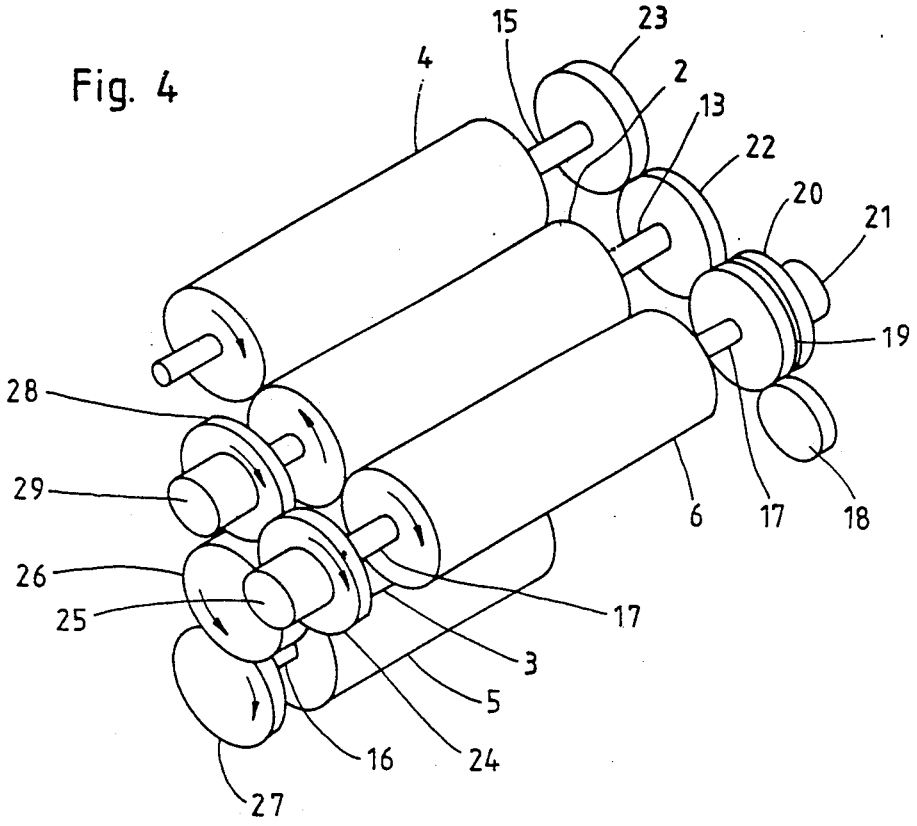
FIG. 4 is a perspective view of the system illustrated in FIG. 3, and showing the arrangement of the clinders and clutches, in space.

Referring now to FIGS. 3 and 4: FIG. 3 illustrates the cylinders 2–6 on the respective shafts or shaft stubs 13–17. The shafts 13–17 have gears placed thereon. A main or machine drive is derived from a gear 18. Gear 18 meshes with the printing cylinder gear 19, located on the printing cylinder shaft 17 of the printing cylinder 6. Gear 19 is welded on shaft 17, as shown schematically in FIG. 3. Loosely seated on shaft 17 is a gear 20. Secured to shaft 17 is a first impression cylinder clutch 21 which, when engaged, will couple the gear 20 to the shaft 17. Shaft 17, at its left side—with respect to FIG. 3—has a second gear 24 located loosely thereon which can be engaged with the shaft 17 upon engagement of the clutch 25.

A first blanket cylinder gear 22 is secured to a first blanket cylinder shaft 13 of the first blanket cylinder 2. A first plate cylinder gear 23, secured to shaft 15 of the first plate cylinder 4, is in continuous operating engagement with the first rubber cylinder gear 22. Upon operation of the first impression cylinder clutch 21, the impression cylinder 6 can be connected or coupled for driving engagement with the upper blanket cylinder—plate cylinder couple 2, 4. The second blanket cylinder—plate cylinder couple 3, 5 can be disengaged or stopped in this operation.

The left side of the cylinder arrangement carries further gears and clutches. Thus, the second impression cylinder gear 24 can be coupled to the impression cylinder shaft 17 by engaging the second impression cylinder clutch 25. The second impression cylinder gear 24 is in meshing engagement with a second blanket cylinder gear 26. Preferably, the second blanket cylinder gear 26 has double width. It is secured, for example by welding, to the second blanket cylinder shaft 14 to drive the second blanket cylinder 3. The second plate cylinder 5 is driven via shaft 16 and the second plate cylinder gear 27, which is secured to the shaft 16 and meshes with the double-width gear 26—see FIGS. 3 and 4.

If it is desired to change the plate of the first plate cylinder 4 while continuing to print between the second blanket cylinder 3 and the impression cylinder, that is, make a flying plate change it is necessary to disengage clutch 21 and, in its stead, engage clutch 25. This permits common drive of the impression cylinder 6 and of the lower blanket—plate cylinder couple 3, 5. The disengaged clutch 21 permits interchange of a plate from the plate cylinder since no drive connection will be effected and the couple 2, 4 is stopped.

By selective operation of the clutches 21, 25, and corresponding engagement of the respective blanket cylinders 2, 3 on the impression cylinder 6, it is possible to selectively drive the upper blanket—plate cylinder couple 2, 4 as well as the lower blanket—plate cylinder couple 3, 5 so that, upon guiding of the web 1 in accordance with FIG. 2, two-color prime printing can be effected.

In accordance with a feature of the invention, the shaft of one of the blanket cylinders, for example the shaft 13 of the upper or first blanket cylinder 2, carries a further gear 28, loosely connected on the shaft, but engageable therewith upon operation of a third clutch 29. Thus, by engaging the third clutch 29, the further gear 28 can be selectively engaged with the shaft 13. The further gear 28 is in continuous meshing coupling connection with the double-width second rubber blanket gear 26. The drive need not be direct, but may be indirect. Of course, the second impression cylinder 24 is in continuous engagement with the second blanket cylinder gear 26. The double-width shape of the gear 26 thus permits engagement of two gear wheels therewith.

The arrangement permits operation of the printing machine for prime-and-verso printing by guiding the web as shown in FIG. 1 between the two blanket cylinders 2, 3; the impression cylinder 6 then will operate only as a paper guide roller or cylinder. To cause this operation, the third clutch 29 and the first impression cylinder clutch 21 must be engaged, while the second impression cylinder clutch 25 is released. This results in drive from the main gear 18 to gear 19 because of the engaged clutch 21 through gear 22. Gear 22, seated on shaft 13, will then rotate conjointly with gear 28 due to the engagement of the third clutch 29. Drive is transmitted to the double-width second blanket cylinder gear 26, hence to the second blanket cylinder 3. Of course, the associated printing cylinders 4 and 5 are also driven via the engaged gears 23, 27, respectively. Thus, all cylinders 2–6 are driven, whereby, however, in accordance with a feature of the invention, a reversal of direction of rotation of the blanket—plate cylinder couple 3, 5 is obtained with respect to the direction of rotation of those cylinders when operating in the printing mode shown in FIG. 2—compare rotation arrows within the respective cylinders of FIGS. 1 and 2. It is to be noted that the impression cylinder 6, which receives its drive from the main drive gear 18, rotates in the same direction in both the embodiments of FIGS. 1 and 2.

For double prime color printing as well as for single prime color printing in which printing plates can be exchanged while the machine is operated, clutches 21 and 25 or, respectively, clutches 21 or 25 are engaged. In either operating mode, the third clutch 29 is disengaged. The further gear 28 is carried along by engagement with the second blanket cylinder gear 26, of double width, but rotates freely on shaft 13 which, then, will rotate in opposite direction to the rotation of the gear 28 in case the lower cylinder couple 3, 5 is operating—which will be the case if clutch 25 and clutch 21 are engaged.

As best seen in FIGS. 3 and 4, the gears can remain in continuous engagement regardless of the operating mode. No profile shifting is necessary.

Various changes and modifications may be made; for example, the arrangement for double prime printing and for plate exchange while printing of single color printing is carried out can be changed by suitable rearrangement of the clutches. Of course, placement of the clutches and gears on only one side of the cylinders or in different side arrangements is possible.

The gears 24, 26, 28 can be engaged directly with each other. On very large machines, however, it may be desirable to introduce between the gears either additional gear pairs—if the direction of rotation is to be maintained—or single gears, which will result in reversal of direction of rotation. Such additional coupling gears have been omitted from the drawings and are not specifically shown since they can be arranged in accordance with well known engineering practice. Thus, reference to "gears being coupled" with each other may refer either to direct meshing engagement or indirect meshing engagement, that is, via coupling gears.

The engagement of the further rubber blanket gear 28 with the double-width second rubber blanket gear 26 is shown in FIG. 3 by the broken line C to schematically indicate the coupled connection.

Various other changes and modifications may be made within the scope of the inventive concept.

We claim:

1. Rotary offset printing machine system, to permit exchange of printing plates while the machine is in operation and while a first plate cylinder—blanket cylinder couple (2, 4) continues to operate while a second plate cylinder—blanket cylinder couple (3, 5) is stopped to permit exchange of a printing plate on the plate cylinder (5) of the second couple, the system having a printing or impression cylinder (6) against which the first and second blanket cylinders of the respective couples can be selectively engaged or disengaged;

said system having a main drive gear (18);

a connection gear (19) coupled to a shaft (17) of the impression cylinder (6) and driven from said main drive gear;

a first impression cylinder gear (20) on said impression cylinder shaft (17);

a first clutch (21) associated with said first impression cylinder gear (20) for selectively coupling said first impression cylinder gear with said impression cylinder shaft (17) or disengage therefrom;

a second impression cylinder gear (24) on said impression cylinder shaft (17);

a second clutch (25) associated with said second impression cylinder gear (24) for selectively coupling said second impression cylinder gear with said impression cylinder shaft (17) or disengage therefrom;

a first blanket cylinder gear (22) secured to and rotating with a first blanket cylinder shaft (13) and positioned in coupled engagement with the first impression cylinder gear (20) on the impression cylinder shaft (17);

a second blanket cylinder gear (26) secured to and rotating with a second blanket cylinder shaft (14) and positioned in coupled engagement with one (24) of the impression cylinder gears (20, 24) on the impression cylinder shaft (17), whereby, for prime-and-verso printing, the impression cylinder may operate as a paper guide cylinder for a printing web (1) passed between the first and second blanket cylinders (2, 3) upon selective engagement of the first (21) or second (25) clutch to couple the main drive gear (18) selectively with one of the two blanket cylinder gears (22, 26) via the impression cylinder shaft (17);

said system comprising a further gear (28) located on the first blanket cylinder shaft (13) of the first blanket cylinder (2) freely rotatable on said first blanket cylinder shaft (13) and in engagement with the second blanket cylinder gear (26);

a third clutch (29) associated with said further gear (28) and operable to selectively couple the further gear (28) with the first blanket cylinder shaft (13) of the first blanket cylinder (2) or disengage therefrom, whereby the further gear (28) may be coupled by the third clutch (29) to drive the second blanket cylinder (3) via the second blanket cylinder gear (26) independently of the second impression cylinder gear (24) upon release of the second clutch (25);

and wherein said first, second and third clutches (21, 25, 29) are positive fixed point engagement clutches.

2. The system of claim 1, wherein the first and second clutches (21, 25) are positioned at respectively different sides of the impression cylinder (6);

and wherein the second blanket cylinder gear (26) coupled to the second impression cylinder gear (24) and said further gear (28) comprises a double-width gear (26) to permit continuous coupling engagement between both the second impression cylinder gear (24) and the further gear (28) with said second blanket cylinder gear (26).

3. The system of claim 2, wherein said gears are in direct meshing engagement.

* * * * *